United States Patent [19]

Fisher

[11] Patent Number: 4,869,704

[45] Date of Patent: Sep. 26, 1989

[54] TOY

[75] Inventor: Martin Fisher, Sterling, Mass.

[73] Assignee: Fisher Industries, Inc., South Lancaster, Mass.

[21] Appl. No.: 157,216

[22] Filed: Apr. 11, 1988

Related U.S. Application Data

[63] Continuation of Ser. No. 15,661, Feb. 17, 1987, abandoned.

[51] Int. Cl.[4] ..... A63H 33/00

[52] U.S. Cl. ..... 446/486; 267/157; 267/166.1; 267/199; 267/204; 267/250; 267/272; 267/288; 267/290; 446/69; 446/473

[58] Field of Search ..... 267/156, 157, 166.1, 267/196, 199, 204, 249, 250, 272, 288, 290; 446/487, 486, 473, 69

[56] References Cited

U.S. PATENT DOCUMENTS

| | | | |
|---|---|---|---|
| 144,600 | 11/1873 | Bussell | 267/288 |
| 148,991 | 3/1874 | Schoen | 267/288 |
| 337,048 | 3/1886 | Davis | 267/166.1 |
| 840,027 | 1/1907 | Stucki | 267/204 |
| 1,718,792 | 6/1929 | Main | 446/486 |
| 2,390,937 | 12/1945 | Holland | 29/173 |
| 2,495,967 | 1/1950 | Hamilton | 446/407 |
| 2,751,179 | 6/1956 | Oravec | 267/272 X |
| 3,300,042 | 1/1967 | Gordon | 267/166.1 |

FOREIGN PATENT DOCUMENTS

| | | | |
|---|---|---|---|
| 39400 | 10/1931 | France | 267/250 |
| 754191 | 11/1933 | France . | |

*Primary Examiner*—George E. Halvosa
*Attorney, Agent, or Firm*—Blodgett & Blodgett

[57] ABSTRACT

Spring-like element for use as a toy or the like consisting of a coil of copper tape of high width-to-thickness ratio forming an elongated frusto-conical structure that exhibits spring characteristics combined with dry friction damping.

1 Claim, 1 Drawing Sheet

TOY

This is a continuation of co-pending application Ser. No. 15,661, filed on Feb. 17, 1987, now abandoned.

BACKGROUND OF THE INVENTION

In the design and construction of mechanical elements, there often arises a situation where a spring is desirable which has the characteristic of returning very slowly to a original condition after it has been compressed and released. Such an element is useful as a toy or for incorporation in certain kinds of machinery in which peculiar characteristics of this kind are desirable. This characteristic would exist in a situation where the element desired is not only a spring but also incorporates a degree of Coulomb friction. Mechanical elements of this type in the past have always been very expensive and subject to such deterioration that can quickly render them inoperative. These and other difficulties experienced with the prior art devices have been obviated in a novel manner by the present invention.

It is, therefore, an outstanding object of the invention to provide a spring element combining spring characteristics with damping characteristics.

Another object of this invention is the provision of a spring element useful as a toy by virtue of its exhibiting the characteristic of slow return after compression.

A further object of the present invention is the provision of a spring element which is useful in the entertainment of children or adults.

It is another object of the instant invention to provide a spring element which is simple in construction, which can be manufactured from inexpensive materials, and which is capable of a long life of useful service with a minimum of maintenance.

It is another object of the instant invention to provide a spring element that is useful as a toy, which element can give simple entertainment for a long period of time without danger to a child.

With these and other objects in view, as will be apparent to those skilled in the art, the invention resides in the combination of parts set forth in the specification and covered by the claims appended hereto.

SUMMARY OF THE INVENTION

In general, the present invention consists of a spring element formed from a coil of copper tape of high width-to-thickness ratio, which copper has a degree of plasticity such that it is capable of partial permanent deformation. When the center of the coil is pressed axially in a first direction, the coil forms an elongated frusto-conical structure that when pressed axially in the other direction, exhibits spring characteristics that are combined with a damping characteristics by virtue of the sliding action between the adjacent layers.

More specifically, the spring characteristics are in accordance with Hook's law and the damping characteristics are of the Coulomb friction type.

BRIEF DESCRIPTION OF THE DRAWINGS

The character of the invention, however, may be best understood by reference to one of its structural forms, as illustrated by the accompanying drawings.

DESCRIPTION OF THE PREFERRED EMBODIMENT

Figure 1:
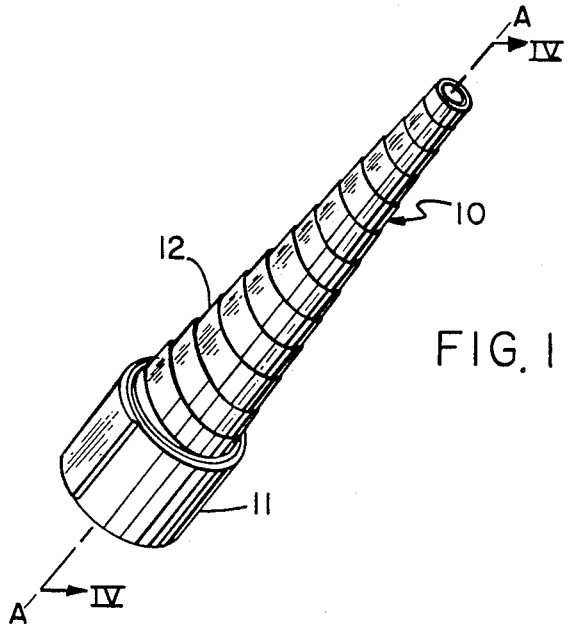
FIG. 1 is a perspective view of a spring element the principles of the present invention.
Figure 4:
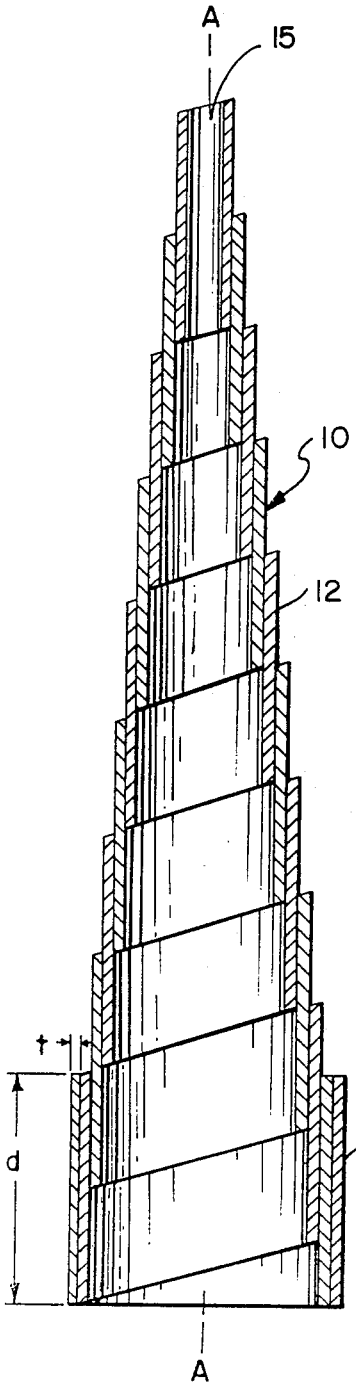
FIG. 4 is a vertical sectional view of the element taken on the line IV—IV of FIG. 1.

Referring first to FIG. 1, which best shows the general features of the invention, it can be seen that the spring element, indicated generally by the reference numeral 10, is formed from a coil 11 of copper tape 12. The tape has a high width-to-thickness ratio and has a degree of plasticity that allows partial permanent deformation. In FIG. 4 it can be seen that the tape is indicated as having a thickness t and a width d in which the ratio t/d is in the order of 10 or more.

Figure 3:
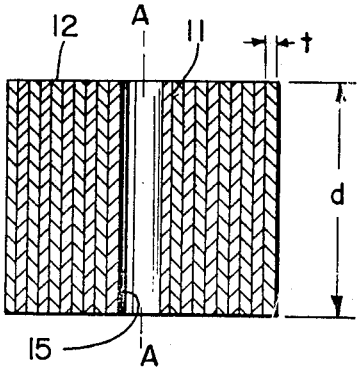
FIG. 3 is a vertical sectional view of a coil from which the spring element is formed.

FIG. 3 shows the coil 11 in its original state; when the center portion of the coil is pressed axially in the vertical direction, the resulting element forms an elongated frusto-conical structure (as shown in FIG. 4) which exhibits spring characteristics in a vertical direction that are combined with damping characteristics by virtue of the sliding action between the adjacent layers of the tape 12. The coil is provided with a hollow center 15 which assists in the permanent deformation to the shape shown in FIG. 1.

Figure 2:
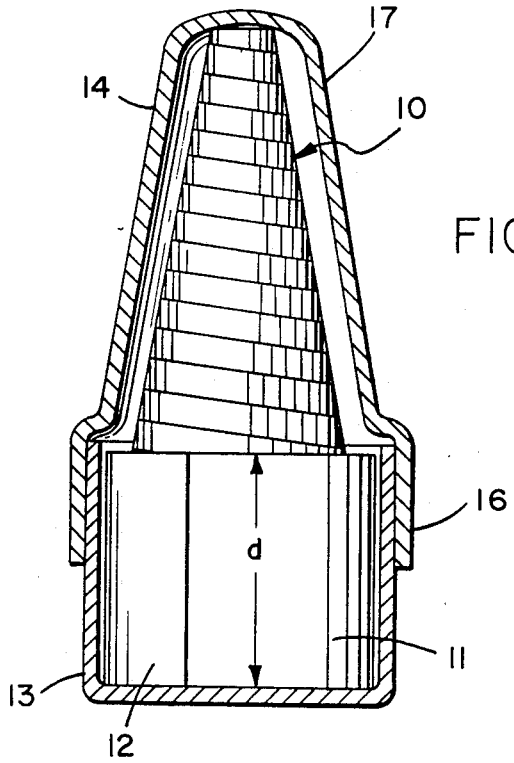
FIG. 2 is a sectional view of a package containing the spring element.

FIG. 2 shows the manner in which the spring element can be packaged for use as a toy. It includes a base 13 in which the coil 11 will normally rest and a cap 14 which has a lower portion 16 fitting tightly around the upper edge of the base 13. The cap has an upper portion 17 having a generally frusto-conical shape that retains the partially-compressed cone of the spring element 10.

The operation of the invention and its advantages will now be readily understood in view of the above description. When sold, the spring element 10 will be enclosed in the package or container in the manner shown in FIG. 2; the coil 11 lies in the base 13 and the upper frusto-conical portion will reside in slightly compressed condition within the cap 14. It has been stated that the element is originally formed by holding the coil 11 in one hand and pressing the layers of tape in the area around the center 15 in an upward direction to obtain the resulting element shown in FIGS. 1 and 4. In those figures, it can be seen that the upper frusto-conical portion is a deformed version of the center layers of the tape 12. The copper of which the coil is formed has been selected of a suitable plasticity that it can be permanently deformed to the shape shown in FIGS. 1 and 4.

When the spring element is placed on a horizontal surface, it can be pressed at the top to compress the spring in a downward direction. When it is released, it returns to its original condition but, because of the friction between the layers of the tape, it returns to that original condition relatively slowly and then goes through a series of compressions and expansions that is highly entertaining. Aside from the natural spring in the axial direction, the friction between the layers of the tape is of the Coulomb friction variety, so that the result is a spring element that not only operates in accordance with Hook's law, but also is subject to a degree of dry damping which makes it operating in a highly interesting manner.

In the preferred embodiment, the copper forming the tape 12 is soft in nature. The width is in the order of magnitude of 1 inch and the thickness is in the order of 0.004 inches.

In the preferred embodiment, the length of the tape 12 in the coil 11 is in the order of 4 feet and produces a cone that is around 2 inches long. However, the length of the tape in the coil may be in the range from 50 to 58 inches, the width in the range from 0.75 inches to 1.00 inches, and the thickness in the range from 0.003 inches to 0.005 inches.

It can be seen that the present invention not only involves a highly interesting mechanical element that can be used as a toy for a child or as an executive toy that is highly entertaining and whose operation involves an interesting explanation of the principles of physics. The peculiar spring action, of course, is due to the tension transversely of the metallic tape (rather than perpendicular as is usual with leaf springs or the like). The friction, of course, depends on the smoothness of the surface of the tape, but is almost pure Coulomb friction unless oil is added to the surface to lend a degree of viscous damping. When the spring element is incorporated in a package with the cap 14 and the base 13, it is readily transported from place to place and is particularly useful to adults who wish to entertain small children in places where larger toys are not available.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Toy, comprising:

(a) a coil of copper tape of high width-to-thickness ratio which has a degree of plasticity such that, when the center of the coil has first been pressed expanded in a first direction, forms an elongated frusto-conical structure that, when later pressed axially in the other direction and quickly released, exhibits spring characteristics combined with damping characteristics by virtue of sliding action between the adjacent layers, wherein the spring characteristics are in accordance with Hook's Law and the damping characteristics are of the Coulomb friction type, so that the spring element, after being released, exhibits alternating reversal of movement for an observable period of time, and (b) a package consisting of a base and a frusto-conical cap, wherein the coil normally rests in the base and the cap has a lower portion fittingly around an upper edge of the base, so that, when the cap is removed from the base, the coil expands outwardly and exhibits the spring characteristics, wherein the copper is soft in nature, wherein the length of the tape in the coil is in the range from 50 inches to 58 inches, the width is in the range from 0.75 inches to 1.00 inches, and the thickness is in the range from 0.003 inches to 0.005 inches.

* * * * *